US008578735B2

(12) United States Patent
Seliktar

(10) Patent No.: US 8,578,735 B2
(45) **Date of Patent: *Nov. 12, 2013**

(54) JEWELRY ARTICLE

(75) Inventor: Ronen Seliktar, Long Island City, NY (US)

(73) Assignee: Select Jewelry, Inc., Long Island City, NY (US)

( * ) Notice: Subject to any disclaimer, the term of this patent is extended or adjusted under 35 U.S.C. 154(b) by 165 days.

This patent is subject to a terminal disclaimer.

(21) Appl. No.: 12/788,883

(22) Filed: May 27, 2010

(65) Prior Publication Data

US 2010/0300149 A1 Dec. 2, 2010

Related U.S. Application Data

(60) Provisional application No. 61/181,574, filed on May 27, 2009.

(51) Int. Cl.
*A44C 25/00* (2006.01)

(52) U.S. Cl.
USPC ..... 63/34; 63/33; 63/35

(58) Field of Classification Search
None
See application file for complete search history.

(56) References Cited

U.S. PATENT DOCUMENTS

| | | | | |
|---|---|---|---|---|
| 4,186,234 | A | 1/1980 | Sakashita et al. | |
| 5,575,900 | A | 11/1996 | Antelman et al. | |
| 5,891,317 | A | 4/1999 | Teichmann et al. | |
| 6,355,304 | B1 | 3/2002 | Braun | |
| 6,365,224 | B1 | 4/2002 | Yoshimura et al. | |
| 8,112,963 | B2 * | 2/2012 | Johnson | 52/698 |
| 2002/0058153 | A1 | 5/2002 | Yoshimura et al. | |
| 2005/0274445 | A1 * | 12/2005 | Chang | 156/63 |
| 2006/0267773 | A1 * | 11/2006 | Roque | 340/572.7 |
| 2007/0068196 | A1 | 3/2007 | Seliktar | |
| 2007/0199988 | A1 | 8/2007 | Labgold et al. | |
| 2009/0038340 | A1 | 2/2009 | Rullman | |

OTHER PUBLICATIONS

Search Report issued by PCT Patent Office in connection with corresponding application No. PCT/US 10/36400 on May 27, 2010.

* cited by examiner

*Primary Examiner* — Jack W. Lavinder
(74) *Attorney, Agent, or Firm* — Ostrolenk Faber LLP

(57) ABSTRACT

A jewelry piece is formed with a jewelry body made of epoxy material, defining an outer surface and cast in the shape of a piece of jewelry in the form of a ring, pendant, earring, brooch, bracelet, anklet, necklace, and the like. The epoxy has a material density approximating that of gold and the decorative metal layer made of precious metal is affixed to the outer surface of the jewelry body in a thickness greater than 0.125 μm. The decorative body may be surface mounted to the jewelry or it may be inlaid or affixed in other similar fashion.

18 Claims, 1 Drawing Sheet

JEWELRY ARTICLE

RELATED APPLICATIONS

This application claims the benefit of U.S. Provisional Application No. 61/181,574, filed May 27, 2009, the entire disclosure of which is incorporated by reference herein.

BACKGROUND OF THE DISCLOSURE

Jewelry and its manufacturing have changed little over the years. To manufacture a ring, for example, molten metal is generally poured into a mold to form the ring. Jewelry is manufactured using a vast selection of different metals, stones, shapes, sizes, and designs. Furthermore, every individual has his/her own tastes and preferences for any of the metals, stones, shapes, or other design parameters.

Consumers often desire to wear inexpensive precious metal jewelry, which has an appearance of an expensive solid jewelry piece.

Natural materials, e.g., flowers, leaves, bark, roots and herbs, in combination with polymers permitting molding of precise forms, have also been used to manufacture jewelry. Additionally, copolymers, such as epoxy, have been utilized in jewelry manufacturing. Epoxy is a copolymer formed from two different chemicals, i.e., a resin and a hardener.

SUMMARY OF THE DISCLOSURE

In one general aspect, the present invention is an article of jewelry cast from epoxy material and having a surface layer of a precious metal.

In particular embodiments thereof, the novel article of jewelry comprises a jewelry piece with a jewelry body made of epoxy material, defining an outer surface, cast in the shape of a piece of jewelry such as a ring, pendant, earring, brooch, bracelet, anklet necklace and the like, and having a material density approximating that of gold. By approximating the material density of gold is meant that the material density of the epoxy is within ±40% that of gold. In addition, a decorative layer made of precious metal is affixed to the outer surface of the jewelry body. The decorative layer is substantive in body and is not merely a plating of gold, which is typically less than 0.125 μm in thickness.

In a preferred embodiment, the gold is in the range 14-18 karat and the decorative metal layer may cover potentially the entirety of the outer surface of the jewelry body. Regardless, the thickness of the decorative metal layer is less that ¼ the thickness of the jewelry body, and preferably even less.

In other embodiments, the decorative metal layer may be formed as a plurality of separate design elements which are individually visually discernable. A clear layer of synthetic material may be applied over the decorative metal layer in thickness from 1.0 mm-1.5 mm within a range of ±20%. The jewelry body may be made of an epoxy which is thermally curable and colorless. A colorant may be dispersed in the epoxy to imbue it with a desired color. Different sections of the epoxy body may be colored differently, if desired.

Either the decorative metal layer or the jewelry body, or both, can be diamond cut, or otherwise textured and an enamel cover may be applied, as well as a personalized decoration.

An RF tag may be embedded in the jewelry to enable locating it in case it has been misplaced. In addition to the gold metal layer, precious or semi-precious stones or combinations thereof may be applied either to the jewelry body or at the decorative metal layer to enhance the visual appearance of the jewelry.

The above aspects, advantages and features are of representative embodiments only. It should be understood that they are not to be considered limitations on the invention as defined by the claims. Additional features and advantages of the invention will become apparent in the following description, from the drawings, and from the claims.

BRIEF DESCRIPTION OF THE DRAWINGS

The invention is illustrated by way of example and not limitation and the figures of the accompanying drawings in which like references denote like or corresponding parts, and in which.

DETAILED DESCRIPTION OF THE PREFERRED EMBODIMENTS AND THE DRAWINGS

Figure 1:
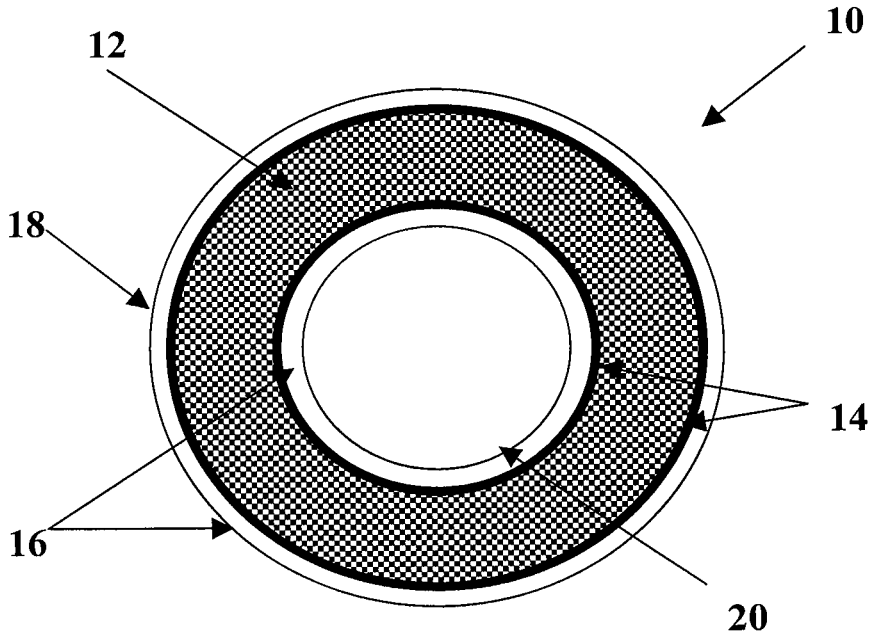
FIG. 1 is a cross-sectional view of the jewelry article in accordance with the preferred embodiment of the invention.

As shown in FIG. 1, jewelry article 10 preferably includes a solid body 12 and a precious metal layer 14. Solid body 12 is preferably made from a thermally curable epoxy material. Other epoxies such as a UV curable epoxy may be used without departing from the spirit of the present invention. The epoxy material is typically colorless. However, solid body 12 can be manufactured to have any desired color by adding a colorant or a pigment to the epoxy mixture.

The precious metal layer 14 is cast from a precious metal, such as an alloy of gold, silver or platinum. Layer 14 is applied to the outer surface of the solid body 12 and is preferably more than 0.125 μm in thickness. 14- or 18-karat gold or platinum may be used for the precious metal layer 14. Some people are allergic to the fillers used in low-karat weight precious metals. This problem is avoided in the present jewelry article where high-karat weight precious metals can be used without rendering the jewelry prohibitively expensive.

Figure 2:
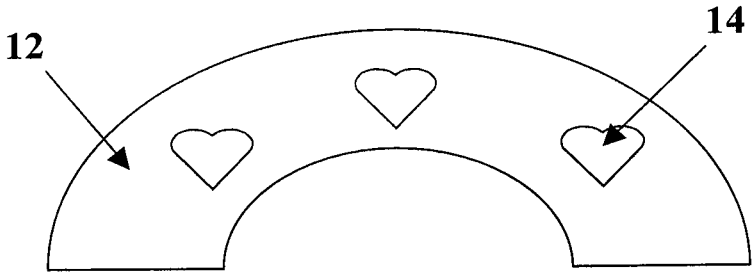
FIG. 2 is a front view of a portion of the jewelry article in accordance with another preferred embodiment of the invention.

Although layer 14 is shown as a solid layer, it may be shaped as separate design elements placed on either the solid surface of the solid body 12 or placed into cut-out cavities formed on the surface of the solid body 12. This embodiment is illustrated in FIG. 2. Any desired combination of the precious metal and epoxy may be utilized. Because the weight of a jewelry article cast from the epoxy is approximately the same as the weight of a similarly sized jewelry article made from solid precious metal, jewelry article 10 better approximates the look and feel of a solid precious metal piece than other known techniques. Specifically, jewelry made from hollow precious metals is typically 80% lighter than a similar solid piece. Further, a jewelry article constructed in accordance with the preferred embodiment does not bend or lose its shape as a hollow piece of jewelry would.

Additionally, a clear layer 16 may be applied over the entire jewelry article to protect the precious metal layer 14 and to provide more comfort to the wearer. A preferred material for the layer 16 is a thermally curable colorless epoxy. The clear layer 16 is preferably 1.0 mm-1.5 mm thick with a tolerance of ±20%. Although in FIG. 1 the preferred embodiment includes all three cast layers, it should be understood that the solid body 12 layer and the precious metal layer 14 may be sufficient to achieve the desired effect.

Texture renders the exterior surface of an article of jewelry more brilliant. Diamond cutting is a conventional jewelry making technique for creating texture surfaces on the surface of an article of jewelry made from a metal such as gold, silver, platinum and the like. Diamond cutting involves the use of a very sharp, knife-like instrument which cuts into the metallic surface of an article of jewelry. Essentially, the purpose of diamond cutting is to form light reflective surfaces in different orientations to reflect light in multiple directions to create the effect of a light kaleidoscope which results in a brilliant sparkle that enhances the beauty of the article of jewelry.

To add various textures to the jewelry article 10, the surface of the solid body 12 may include diamond cutting. The precious metal layer 14 may then mimic the diamond-cut design of the solid body such that the appearance of a solid metal jewelry article with a diamond-cut surface is created. The outer clear layer 16, according to the present invention, allows for the transmission of light to the precious metal layer 14 over which the clear layer 16 is disposed. The light so transmitted is then reflected by light reflective surfaces of the layer 14 in multiple directions and re-transmitted through the clear layer 16, thus creating a kaleidoscope effect.

Further, the surface 18 of the outside clear layer 16 may be also subjected to diamond cutting or any other decorative effect-creating technique. Thus, additional texture or visual effects may be created. Also, surface 20 of the inner clear layer 16 may also be filed for the comfort of the wearer or to provide additional effect.

To provide further visual effect, an enamel layer may be utilized with the jewelry article 10.

Because each layer 12-16 is individually cast, it is possible to personalize each jewelry article not only by including individual design of the precious metal layer 14, but also by pre-recording personal information on an RF tag or a chip, which is cast into the solid body 12.

Additionally, for further aesthetic effect, precious or semi-precious stones may be set into the solid body 12, the precious metal layer 14 or the outside clear layer 16.

For the convenience of the reader, the above description has focused on a representative sample of all possible embodiments, a sample that teaches the principles of the invention and conveys the best mode contemplated for carrying it out. The description has not attempted to exhaustively enumerate all possible variations. Other undescribed variations or modifications may be possible. For example, where multiple alternative embodiments are described, in many cases it will be possible to combine elements of different embodiments, or to combine elements of the embodiments described here with other modifications or variations that are not expressly described. Many of those undescribed variations, modifications and variations are within the literal scope of the following claims, and others are equivalent.

What is claimed is:

1. A jewelry piece, comprising:

a jewelry body made of epoxy material, defining an outer surface, cast in the shape of a piece of jewelry; and a decorative, non-plated metal layer made of cast gold affixed to the outer surface of the jewelry body in a thickness greater than 0.125 μm, wherein the jewelry body has a thickness dimension and wherein the ratio of the thickness of the decorative metal layer to the thickness of the jewelry body is less then 0.25.

2. The jewelry piece of claim 1, wherein the decorative metal layer covers substantially the entirety of the outer surface of the jewelry body.

3. The jewelry piece of claim 1, wherein the decorative metal layer is formed as a plurality of separate design elements which are individually visually discernable.

4. The jewelry piece of claim 1, further comprising a clear layer of synthetic material applied over the decorative metal layer and substantially covering the entirety of the outer surface of the jewelry piece and provided in a thickness from 1.0 mm-1.5 mm±20%.

5. The jewelry piece of claim 1, wherein the jewelry body made of epoxy is comprised of a thermally curable colorless epoxy.

6. The jewelry piece of claim 5, further comprising a colorant dispersed in the thermally curable colorless epoxy to imbue a color to the jewelry body.

7. The jewelry piece of claim 1, wherein the decorative metal layer is diamond cut.

8. The jewelry piece of claim 1, wherein at least one section of the outer surface of the jewelry body is textured.

9. The jewelry piece of claim 1, wherein the jewelry piece comprises an enamel cover.

10. The jewelry piece of claim 1, wherein the jewelry piece includes a personalized decoration.

11. The jewelry piece of claim 1, wherein the jewelry piece is provided with an embedded RF tag that enables it being physically located in a case of misplacement.

12. The jewelry piece of claim 1, further comprising at least one semi-precious or precious stone mounted to the jewelry piece.

13. The jewelry piece of claim 12, wherein the semi-precious or precious stone are mounted to the outer surface of the jewelry body.

14. The jewelry piece of claim 12, wherein the semi-precious or precious stone are mounted to the decorative metal layer.

15. The jewelry piece of claim 1, wherein the decorative metal layer is applied to the outer surface.

16. The jewelry piece of claim 1, wherein the decorative metal layer is inlaid in the jewelry body.

17. The jewelry piece of claim 1, the jewelry piece has the shape of a ring, pendant, earring, broach, bracelet, anklet or necklace and having a material density approximating that of gold.

18. The jewelry piece of claim 1, wherein the piece of jewelry is one of a ring, pendant, earring, broach, bracelet, anklet, and necklace.

* * * * *